United States Patent [19]

Honda et al.

[11] Patent Number: 4,566,777

[45] Date of Patent: Jan. 28, 1986

[54] PROCESS KIT FOR IMAGE FORMING APPARATUS

[75] Inventors: Haruhisa Honda; Shigeyoshi Onoda, both of Yokohama; Fumio Nishino, Tokyo, all of Japan

[73] Assignee: Canon Kabushiki Kaisha, Tokyo, Japan

[21] Appl. No.: 523,365

[22] Filed: Aug. 15, 1983

[30] Foreign Application Priority Data

Aug. 23, 1982 [JP] Japan ..... 57-145803
Aug. 23, 1982 [JP] Japan ..... 57-145804

[51] Int. Cl.[4] ..... G03G 21/00

[52] U.S. Cl. ..... 355/3 R; 355/3 CH; 355/15; 361/225

[58] Field of Search ..... 355/3 R, 3 DR, 133, 355/8, 11, 3 CH, 15; 361/230, 225

[56] References Cited

U.S. PATENT DOCUMENTS 3,891,846 6/1975 Ito ..... 361/230 X
3,978,379 8/1976 Delvecchio ..... 361/230
4,270,856 6/1981 Goida ..... 355/77 X
4,462,677 7/1984 Onoda ..... 355/3 DR
4,470,689 9/1984 Nomura et al. ..... 355/3 DR

*Primary Examiner*—R. L. Moses
*Attorney, Agent, or Firm*—Fitzpatrick, Cella, Harper & Scinto

[57] ABSTRACT

An image forming apparatus includes a process kit detachably mountable thereinto, the process kit having a casing in which an electrophotographic type photosensitive member, a corona discharging device, a development device and a cleaning device are contained as a unit, the casing of the process kit including a slit-like opening formed therein at a position opposed to the corona discharging device within the process kit and an openable light-blocking member of a flexible sheet which extends along the slit-like opening to block external light toward the electrophotographic type photosensitive member within the casing of the process kit. A cleaner may be inserted into the casing through the slit-like opening to clean the corona discharging wire within the casing.

16 Claims, 10 Drawing Figures

PROCESS KIT FOR IMAGE FORMING APPARATUS

BACKGROUND OF THE INVENTION

1. Field of the Invention

The present invention relates to an image forming apparatus using a process kit detachably mountable thereinto, the process kit having a casing in which process means, including corona discharging means, are contained as a unit.

2. Description of the Prior Art

In general, electrophotographic type image forming systems require replacement of a photosensitive member, resupply and replacement of developer, cleaning of corona discharging wire or other adjustments and replacements after the systems have been used for a prolonged period of time. Heretofore, such maintenance has been performed by an expert serviceman.

There have been proposed new methods by which an image forming apparatus can be maintained always in good condition without the need of relying on the expert serviceman. One of these methods is such that the used process means in the system, including a corona discharger, development device, photosensitive drum and others, can be replaced singly or in combination by fresh process means. The combination of process components will be called a process kit hereinafter.

If such a process kit is simply exchanged with another one, a user can selectively use one of various process kits having different predetermined development performances and image reproducibilities in accordance with his desire of copy. For example, differently colored images can be obtained by using three process kits containing black-, red- and blue-colored developers, respectively.

Where such a process kit is used, a corona discharger is so designed that it requires no maintenance such as cleaning under its normal application before the effective life of the process kit expires. Depending on the conditions under which the process kit is used, however, it is not always ensured that the image forming apparatus can satisfactorily continue to operate without maintenance. For example, if the image forming system is used in a dusty circumstance or if a process kit is mounted into the image forming system after this process kit has been kept out of the image forming apparatus for a prolonged period of time, any external matter such as dust, dirt and others may adhere to a corona discharging wire to degrade the obtained image, even within the service life of that process kit. It is, therefore, required that the corona discharging wire in the process kit can be cleaned to maintain it clear so that images of good quality will always be obtained.

SUMMARY OF THE INVENTION

It is a principal object of the present invention to provide a process kit including a corona discharging wire which can easily be cleaned externally of the process kit casing.

Another object of the present invention is to provide a process kit in which any external light may be blocked on cleaning the corona discharging wire.

To accomplish the above objects, the present invention provides a process kit comprising an opening formed in the casing of the process kit and through which a cleaning member can be inserted into the casing of the process kit to clean a corona discharging electrode within the process kit, and openable light-blocking means disposed along the opening.

These and other objects and features of the present invention will be more apparent from reading the following detailed description in connection with the accompanying drawings.

DESCRIPTION OF THE PREFERRED EMBODIMENTS

First of all, an image forming apparatus usable with a process kit will be described with reference to FIG. 1 in which the image forming apparatus is shown in section.

Figure 1:
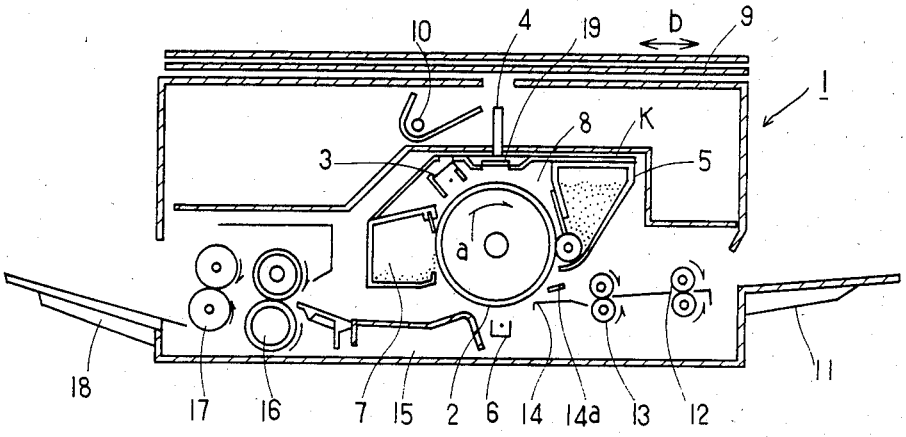
FIG. 1 is a cross-section of an image forming apparatus to which the present invention is applied.

In FIG. 1, an image forming apparatus 1 such as a copying machine or the like is of an electrophotographic type and comprises a photosensitive drum 2 which is supported within the apparatus at the middle thereof to be rotatable in the direction shown by the arrow a. Around the photosensitive drum 2 there are disposed a corona discharger 3, an array of optical elements 4 each having a short focal length, a development device 5, a transfer corona discharger 6, a cleaning device 7 and others.

The image forming apparatus 1 further comprises an original carriage 9 reciprocatable in the direction of the arrow b, a lamp 10 for illuminating the original, a transfer sheet supply tray 11, registration rollers 12, transporting rollers 13, guide members 14 and **14*a* for conducting a transfer sheet between the transfer corona discharger 6 and the photosensitive drum 2, a passage 15 through which the transfer sheet is moved after transfer, a fixing device 16, discharging rollers 17, a copy tray 18 and a color correction filter 19**.

The photosensitive drum 2 is uniformly charged into a preselected polarity by the corona discharger 3 and then irradiated through the optical element array 4 by the light emitted by the illumination lamp 10 and then reflected by the original on the original carriage 9. As a result, an electrostatic latent image is formed on the surface of the photosensitive drum 2. The electrostatic latent image thus formed is developed by the development device 5. The developed image is transferred with the aid of the transfer corona discharger 6 to a transfer sheet which is transported thereto. After the transfer step, the transfer sheet is moved to the fixing device 16 through the passage 15, at which the image on the transfer sheet is fixed thereto. Thereafter, the transfer sheet having the fixed image is discharged onto the tray 18. On the other hand, the surface of the photosensitive drum 2 is cleaned by the cleaning device 7 after the transfer step, and then, it is ready for reuse.

In the illustrated embodiment, the photosensitive drum 2, the corona discharger 3, the development device 5 and the cleaning device 7 are contained in a casing to form a process kit K which can detachably be mounted into the image forming apparatus. In connection with this, the process kit K may include any other combination of process means other than the above components.

Furthermore, transfer sheets may be transported from a cassette (not shown) to the registration rollers 12 through feed rollers.

Figure 2:
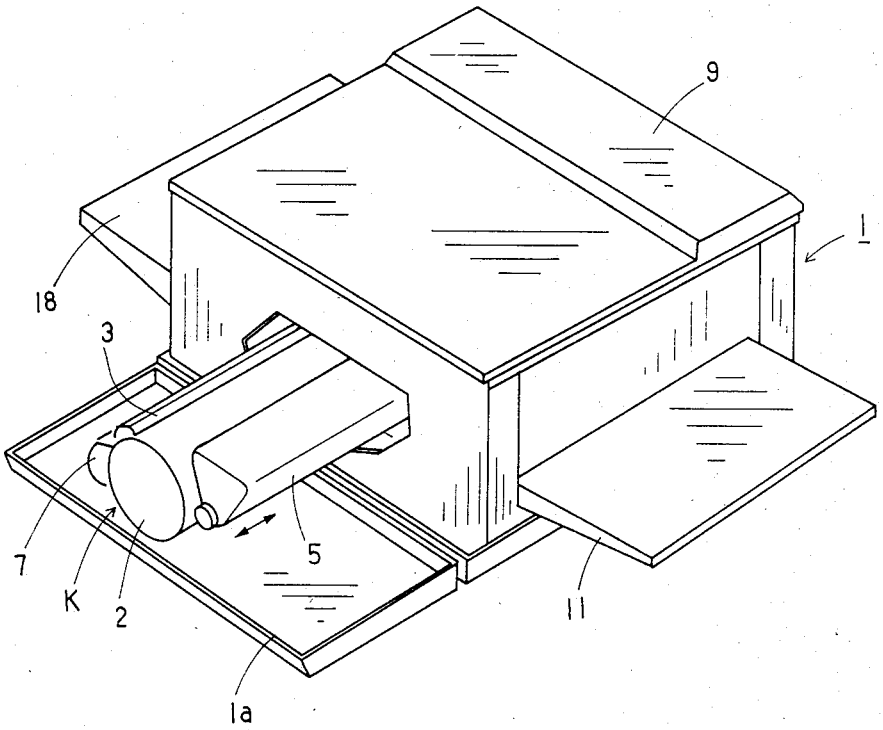
FIG. 2 is a perspective view of the image forming apparatus shown in FIG. 1.

FIG. 2 is a perspective view of the image forming apparatus shown in FIG. 1. The image forming apparatus is shown to be in such a state that the process kit K containing the photosensitive drum 2, the corona discharger 3, the development device 5 and the cleaning device 7, is partially drawn out of the apparatus above a front door 1*a* which is opened downwardly. However, the process kit K is shown with its casing being omitted for better understanding.

Figure 3:
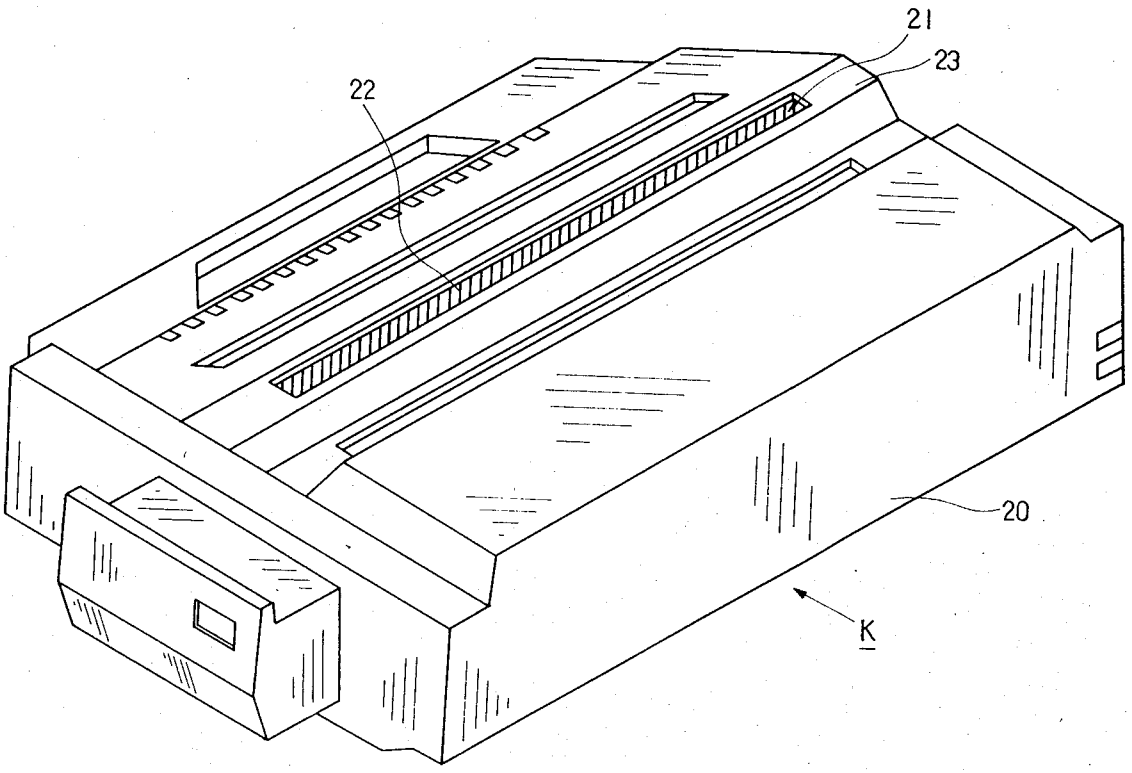
FIG. 3 is a perspective view of a process kit according to the present invention, viewed from one side at which the process kit is held by an operator on setting it thereinto.

FIG. 3 is a perspective view of the process kit K itself, seen from one side at which the process kit is handled by an operator when it is drawn out from the apparatus. On the other hand, FIG. 4 is another perspective view of the same, seen from the opposite side.

The process kit has a casing 20 of a synthetic resin material, such as polyphenylene oxide resin, polycarbonate resin, ABS resin or the like which is colored with a light-blocking pigment. The casing 20 may be also made of any suitable metal material. The casing 20 includes a slit-like opening 21 formed therein at a position near the corona discharger which is located within the casing 20. The slit-like opening 21 extends substantially parallel to the length of a corona discharging wire which is spanned between the opposite ends of the corona discharger 3. The opening 21 is used when the discharging wire is to be cleaned.

The opening 21 is openably closed by a light-blocking colored and flexible sheet member 22 which is normally in its closed position under its own resiliency. The sheet member 22 is provided to prevent the image formation from being adversely affected by any undesirable change in the property of the photosensitive drum produced when it is exposed to the external light for a long time or when the drum is partially exposed to the external light through the opening 21. In the illustrated embodiment, the sheet member 22 was made of polyester sheet material having a thickness of about 250$\mu$, so that good blocking effect could be obtained against dust, light and other elements. When a cleaning operation is carried out through the opening 21 as will be described hereinafter, the flexible sheet member 22 is deformed to expose the opening 21 only at a required area and to maintain the light-blocking function at the remaining area of the opening 21. Thus, the photosensitive drum 2 can effectively be protected against any external light.

Figure 4:
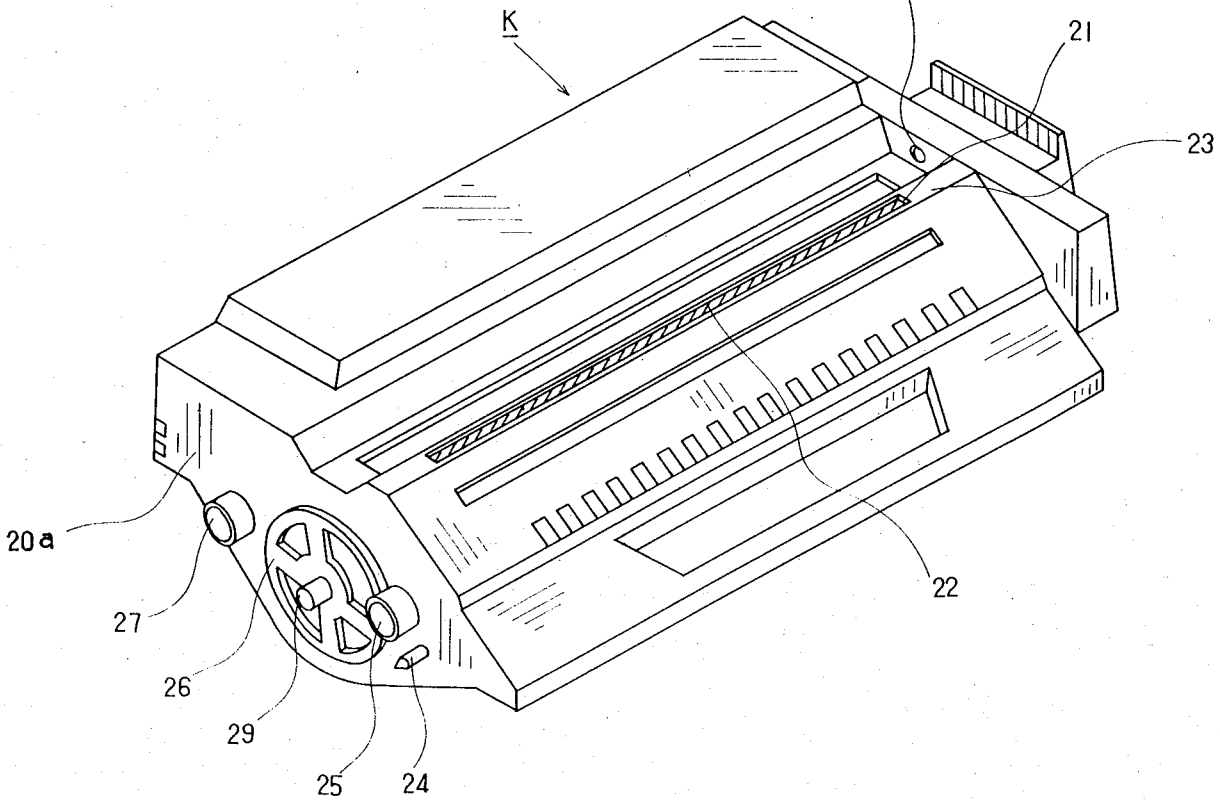
FIG. 4 is a perspective view of the process kit shown in FIG. 3, viewed from the opposite side thereof.

As shown in FIG. 4, the opposite side of the process kit K includes a positioning pin 24 used to properly position the process kit when it is mounted into the image forming apparatus, a connector 25 for applying a high voltage power to the corona discharger 3, a gear wheel 26 for transmitting a driving power to the photosensitive drum 2, and a connector 27 for applying a bias voltage to the developing sleeve of the development device 5. The gear wheel 26 includes teeth which are engaged by the corresponding teeth on a drive wheel provided within the image forming apparatus to transmit the drive power to the photosensitive drum 2.

The final alignment of the process kit relative to the image forming apparatus can be accomplished by engaging a positioning aperture 28 formed in the casing of the process kit K at said one side with a pin (not shown) formed in the image forming apparatus. Reference numeral 29 denotes the shaft of the photosensitive drum.

Figure 5:
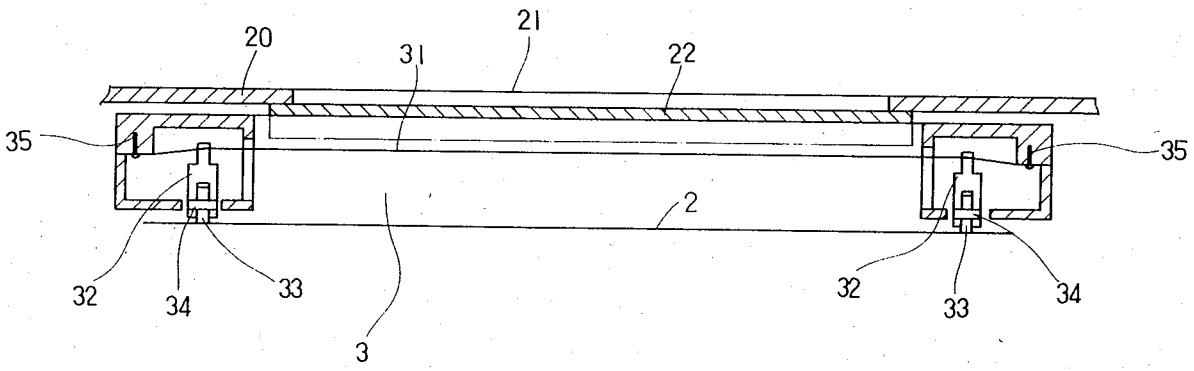
FIG. 5 is a longitudinal cross-section of the process kit shown in FIG. 3, taken along a plane including a discharging wire.
Figure 6:
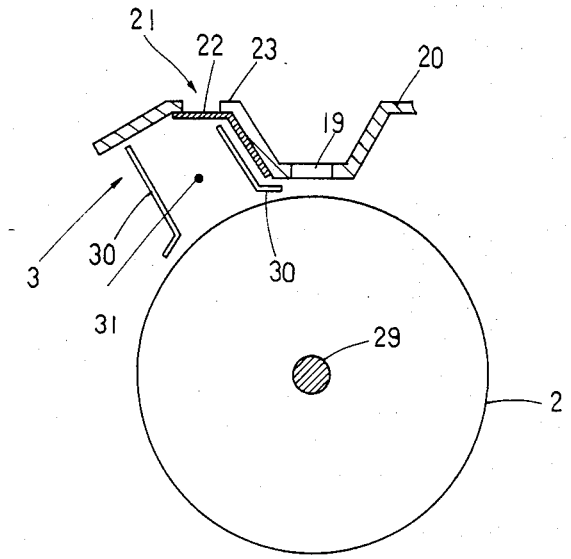
FIG. 6 is a cross-sectional view of the process kit shown in FIG. 3, taken along a plane perpendicular to the discharging wire.

FIG. 5 is a longitudinal cross-section of the corona discharging device, taken along a plane including the discharging wire thereof. FIG. 6 is a cross-section of the same, taken along a plane perpendicular to the discharging wire.

As shown in FIGS. 5 and 6, the corona discharging device 3 includes a shield case 30, a discharging wire 31 and wire confining members 32 each of which contacts the discharging wire at the top end thereof. Each of the wire confining members 32 has a shaft 34 mounted thereon at the lower end, which rotatably supports a roller 33. The wire confining members 32 are held for vertical movement together with the respective rollers 33 which contact with the surface of the photosensitive drum 2. The wire 31 is vertically movable in accordance with the vertical movement of the wire confining members 32. Thus, the discharging wire 31 can properly be positioned at the same time as the photosensitive drum 2 is mounted into the casing of the process kit. In such a manner, the corona discharging device can accurately be set with respect to the photosensitive drum in the process kit casing without any particular positioning operation of the discharging wire. Since the photosensitive drum itself is set in place within the casing of the process kit, the discharging wire 31 is properly maintained parallel to the rotating shaft of the photosensitive drum.

Therefore, if the wall 23 (FIGS. 3 and 4) of the casing 20 in which the opening 21 is formed is maintained parallel to the shaft of the photosensitive drum, the wire 31 is also maintained parallel to the wall 23 of the casing 20. Thus, the discharging wire 31 can be cleaned by a cleaner, which will be described hereinafter, without any excess load and therefore without subjecting it to damage or cut-off when the cleaner is guided by the above wall 23 of the casing 20. If the wall 23 of the casing 20 in which the opening is formed is not parallel to the shaft of the process kit, any suitable guide means may be provided along the length of the opening 21.

Figure 7:
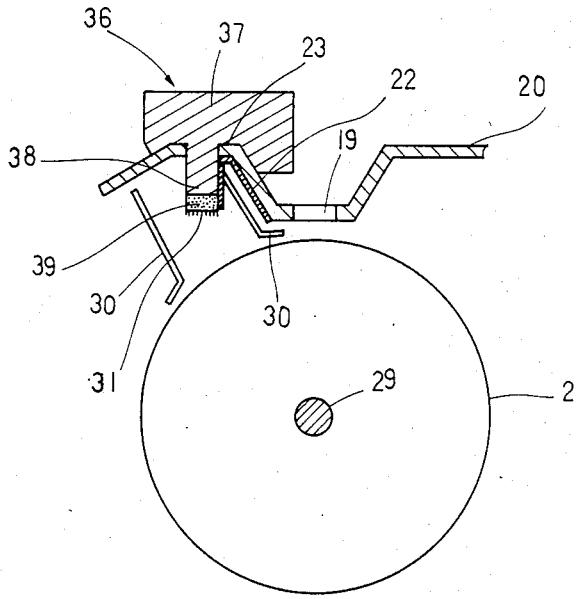
FIG. 7 illustrates the discharging wire being cleaned.
Figure 8:
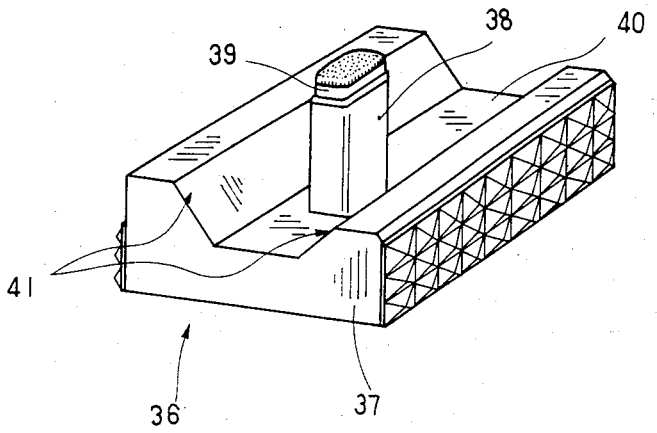
FIG. 8 is a perspective view of a cleaner.

FIG. 7 illustrates a cleaner inserted into the casing 20 through the opening 21 to engage with the discharging wire 31. FIG. 8 is a perspective view of that cleaner.

Figure 9:
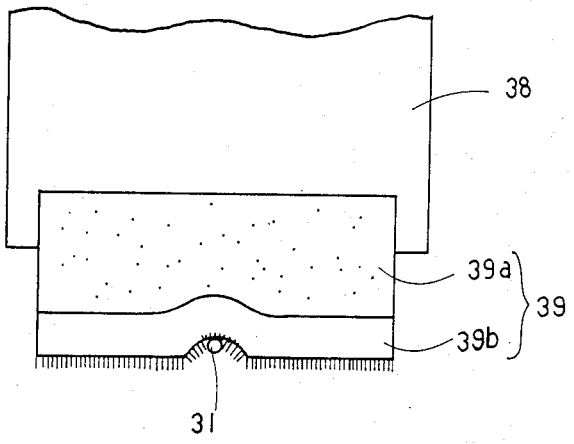
FIG. 9 is a view showing, in an enlarged scale, the tip of the cleaner shown in FIG. 8.

The cleaner 36 comprises, as its major components, a base 37, an arm portion 38 and a cleaning member 39. The base 37 and arm 38 are made of a non-deformable synthetic resin. The base 37 includes a U-shaped groove formed therein at that side of the base 37 which engages in use with the casing 20 of the process kit, that is, the side on which the arm 38 is formed. The cleaner 36 straddles the opening 21 and engages with the wall 23 of the casing 20 at the U-shaped groove of the cleaner base 37. As best seen in FIG. 8, the arm portion 38 extends vertically from the bottom 40 of the U-shaped groove and is of a length slightly smaller than the distance between the wall 23 of casing 20 and the discharging wire 31. On the other hand, a distance from the bottom 40 of the U-shaped groove to the working face of the cleaning member 39 located at the tip of the arm 38 is larger than a distance between the bottom 40 of the U-shaped groove and the discharging wire 31 when the cleaner 36 is set on the casing 20 in place. The cleaning member 39 is made of a material that resiliently deforms sufficiently to provide no damage to the discharging wire 31 when the cleaning member 39 is engaged with the discharging wire 31. The cleaning member 39 may be of a simple construction such as felt, brush or the like. Alternatively, as shown in FIG. 9, the cleaning member 39 may be of a multilayered construction comprising a cushion layer 39*a* of MOLTOPREN, sponge or the like, and a brush-like surface layer 39*b* which consists of a elastomeric substrate and staple fibers planted on the substrate at high density. For the purpose of the present invention, the brush-like surface layer 39*a* is preferable since it provides less frictional resistance when the cleaning member slides on the discharging wire 31. The other effective materials of the brush include nonwoven nylon fabric, velvet and the like. If the length of the staple fibers in the brush is too small, it is hard to clean the entire circumferential surface of the discharging wire 31. On the contrary, pressure of the cleaning member against the discharging wire may be reduced if the length of the staple fibers is too large. Accordingly, the length of the staple fibers in the brush should be chosen to a proper value. The cleaner 36 is used to clean the discharging wire 31 when the cleaner 36 is reciprocated along the opening 21 of the casing 20 with the base 37 thereof held by an operator. At this time, the cleaner 36 is moved with the U-shaped groove bottom 40 of the base 37 thereof engaged by the wall 23 of the casing 20, so that the cleaning member 39 of the cleaner 36 will always contact with the discharging wire 31 to completely clean it. There is also no excess pressure against the discharging wire 31 so that the latter will not be damaged or cut off. Since the base 37 of the illustrated cleaner 36 includes the U-shaped groove formed therein, the side faces 41 of the groove also contribute to the stable movement of the cleaner along the opening 21 of the process kit casing 20.

The flexible sheet member 22 closing the opening 21 of the casing 20 deforms to open the opening 21 only at a position in which the arm portion 38 of the cleaner 36 enters, without opening the remaining portion of the opening 21. Further, the portion of the cleaner base 37 about the arm portion 38 sealingly contacts with the wall portion of the casing 20 surrounding the opening 21 so that the surface of the photosensitive drum will substantially be protected against any external light. In the above arrangement, therefore, the corona discharging wire can properly be cleaned externally through the opening of the process kit casing while preventing the photosensitive member from being subjected to any optical fatigue.

When the arm portion 38 of the cleaner 36 is inserted into the casing 20 through the opening 21 thereof, the sheet member 22 is partially displaced from a position in which it closes the opening 21 as shown in FIG. 6 to another position in which the sheet member 22 is curved as shown in FIG. 7. The deformable portion of the sheet member 22 is preferably of such a width that as it deforms gradually in accordance with the insertion of the arm 38 into the opening 21, the sheet member 22 does not contact the corona discharging wire 31 while at the same time the sheet member 22 perfectly closes the opening 21 at its position shown in FIG. 6.

Although the aforementioned embodiment has been described as having the flexible sheet member for closing the opening 21 of the process kit casing 20, the flexible sheet member may be replaced by a rigid sheet member which can be urged toward its closed position by any suitable resilient means such as a spring.

Figure 10:
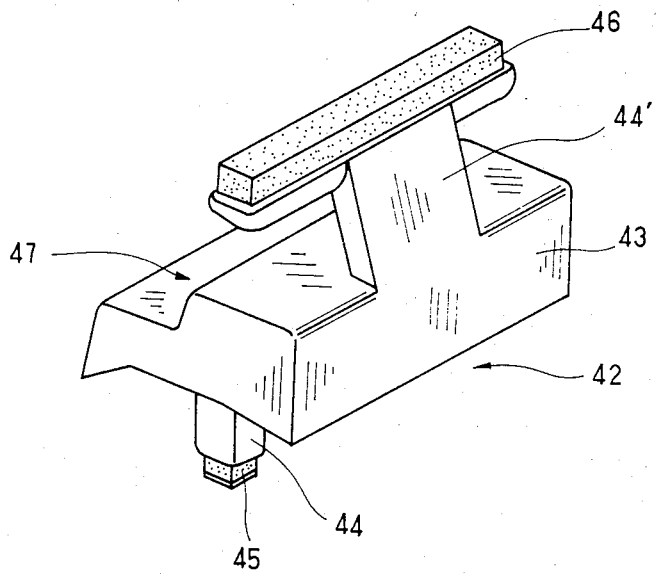
FIG. 10 is a perspective view of a modified cleaner.

FIG. 10 shows a modified cleaner according to the principle of the present invention, which cleaner includes another cleaning member at the opposite portion of the base to clean an optical component, for example, the optical element array 4 in the process kit.

This cleaner 42 comprises a base 43 including a similar U-shaped groove formed therein at one side, an arm portion 44 extending from the bottom of the U-shaped groove in the base 43, a wire cleaning means mounted on the end face of the arm and having a cleaning member 45, another arm portion 44′ extending from the base 43 at the opposite side, and a cleaning member 46 mounted on the tip of the arm portion 44′ and made of sponge or the like. The second cleaning member 46 is used to clean the optical components such as the optical element array and the others in the process kit.

The base 43 of the cleaner 42 includes a stepped portion as shown by 47 at the side of the base from which the arm portion 44′ extends, so that the configuration of the base 43 is matched to the wall configuration of a portion to be cleaned (not shown).

Thus, both the discharging wire and optical element array can be cleaned by a single cleaner.

While the invention has been described with reference to the structures disclosed herein, it is not confined to the details set forth and this application is intended to cover such modifications or changes as may come within the purposes of the improvements or the scope of the following claims.

What is claimed is:

1. A process kit detachably mountable into an image forming apparatus, comprising:

process means for image formation, said process means including corona discharging means or the like having a first opening opposed to a surface to be subjected to the corona discharging operation;

a casing for containing said process means as a unit, said casing being provided with means defining a casing opening along said corona discharging means at a position different from that of said first opening of said corona discharging means, wherein said means defining said casing opening is for allowing a cleaning device access to said corona discharging means and for allowing the cleaning device to move along said corona discharging means to effect a cleaning of said corona discharging means; and a cover movable between a first position for covering said casing opening and a second position wherein said cover is retracted from said first position.

2. A process kit as defined in claim 1 wherein said corona discharging means includes a corona discharging electrode and said opening in said corona discharge means is in the form of a slit which extends parallel to said electrode.

3. A process kit as defined in claim 1 or 2 wherein said cover is in the form of a flexible sheet member extending along said opening in said casing.

4. A process kit as defined in claim 3 wherein said flexible sheet member has such a dimension that it does not contact said corona discharging electrode when said sheet member is deformed while at the same time said sheet member closes said opening in said casing when in its closing position.

5. A process kit as defined in claim 1 or 2 wherein said cover is in the form of a rigid sheet member which is hinged on said casing at said opening therein and is urged toward its closing position by a resilient member.

6. A unit as defined in claim 1 wherein said process kit includes as electrophotographic type photosensitive member, a development device and a cleaning device for cleaning the surface of said photosensitive member, all of which are disposed within said process kit.

7. A cleaning device for the unit according to claim 1, comprising a cleaning member and a support member for supporting said cleaning member.

8. A process kit detachably mountable into an image forming apparatus, comprising:

process means for image formation, said process means including corona discharging means or the like having an opening opposed to a surface to be subjected to the corona discharging operation for image formation;

a casing for containing said process means as a unit, said casing being provided with means defining an opening along said corona discharging means at a position different from that of said opening of said corona discharging means, wherein said means defining said opening of said casing is for guiding a cleaning device for cleaning said corona discharging means through said opening of said casing; and a cover movable between a first position for covering said opening and a second position wherein said cover is retracted from said first position.

9. An image forming apparatus as defined in claim 8 wherein that portion of said process kit casing in which said opening is formed functions as guide means for maintaining the distance between said cleaning means and said corona discharging electrode constant when said corona discharging electrode is being cleaned by said cleaning means.

10. An image apparatus as defined in claim 9 wherein said cleaning means includes a base, an arm portion extending from said base at the side thereof in which it faces to said process kit casing, and a cleaning member mounted on the tip of said arm portion, the wall of said base on which said arm portion is located being shaped to conform to that of said process kit casing when said arm portion is inserted into said casing through said opening to clean said corona discharging electrode.

11. An image forming apparatus as defined in claim 10 wherein said arm portion of said cleaning means is of a length slightly smaller than the distance between the portion of said process kit casing providing said guide means for said cleaning means and said corona discharging electrode, and wherein the length of said arm portion from the working face of said cleaning member mounted on the tip of said arm to the root of the same is larger than the distance between said root of said arm portion and said corona discharging electrode when said cleaning means is set on said casing at its operative position.

12. An image forming apparatus as defined in claim 8 wherein said cleaning means includes a cleaning member having a cushion layer and a brush-like surface layer consisting of a substrate and staple fibers planted on said substrate at high density.

13. An image forming apparatus as defined in claim 8 wherein said cleaning means includes another cleaning member located on said support member for cleaning optical elements.

14. An image forming apparatus as defined in claim 8 wherein said process kit includes an electrophotographic type photosensitive member, a development device and a cleaning device for cleaning the surface of said photosensitive member, all of which are disposed within said process kit.

15. A cleaning device for the image forming apparatus according to claim 8, comprising a cleaning member and a support member for supporting said cleaning member.

16. A process kit according to claim 1 or 8, wherein said cover is opaque.

* * * * *